US008659629B2

(12) United States Patent
Higashiyama

(10) Patent No.: US 8,659,629 B2
(45) Date of Patent: Feb. 25, 2014

(54) IMAGE FORMING APPARATUS, IMAGE FORMING METHOD, AND COMPUTER PROGRAM PRODUCT

(75) Inventor: Makoto Higashiyama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/397,706

(22) Filed: Feb. 16, 2012

(65) Prior Publication Data

US 2012/0229585 A1 Sep. 13, 2012

(30) Foreign Application Priority Data

Mar. 11, 2011 (JP) ..... 2011-054644

(51) Int. Cl.
*B41J 2/385* (2006.01)
*B41J 2/435* (2006.01)
*B41J 2/47* (2006.01)

(52) U.S. Cl.
USPC ..... 347/116; 347/229; 347/234; 347/248

(58) Field of Classification Search
USPC ..... 347/116, 229, 232–235, 248–250
See application file for complete search history.

(56) References Cited

U.S. PATENT DOCUMENTS 7,734,198 B2 6/2010 Higashiyama et al.
8,009,320 B2 * 8/2011 Bae ..... 358/1.18
8,031,220 B2 * 10/2011 Nakahata ..... 347/249
8,090,303 B2 * 1/2012 Hayashi et al. ..... 399/301
8,107,833 B2 * 1/2012 Yoshida ..... 399/44
8,170,430 B2 * 5/2012 Nagatsuka ..... 399/44
2008/0044195 A1 2/2008 Higashiyama et al.
2009/0213401 A1 8/2009 Higashiyama et al.
2010/0253981 A1 10/2010 Higashiyama et al.
2011/0007120 A1 * 1/2011 Motoi et al. ..... 347/116
2011/0103809 A1 * 5/2011 Kuwata et al. ..... 399/16
2011/0128599 A1 * 6/2011 Watanabe ..... 358/518
2012/0008993 A1 * 1/2012 Maeda ..... 399/301
2013/0038885 A1 * 2/2013 Higashiyama ..... 358/1.9

FOREIGN PATENT DOCUMENTS

JP 2004117384 A 4/2004
JP 2009075155 A 4/2009

OTHER PUBLICATIONS

Abstract of JP 2009-075155 published Apr. 9, 2009.
Abstract of JP 2004-117384 published Apr. 15, 2004.

* cited by examiner

*Primary Examiner* — Hai C Pham
(74) *Attorney, Agent, or Firm* — Harness, Dickey & Pierce, P.L.C.

(57) ABSTRACT

An image forming apparatus that includes an optical writing device for applying light corresponding to image data to form a first image of the image data includes: a temperature detecting unit that detects temperature at a plurality of positions in the optical writing device; and an adjustment processing unit that, when a temperature difference between the positions detected by the temperature detecting unit is out of a predetermined range, forms a second image for quality verification and performs a process for adjusting color registration of the first image by using the second image.

8 Claims, 13 Drawing Sheets

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese Patent Application No. 2011-054644 filed in Japan on Mar. 11, 2011.

BACKGROUND OF THE INVENTION

1. Field of the Invention

The present invention relates to an image forming apparatus, such as a copying machine or a printer, an image forming method, and a computer program product for forming a color image.

2. Description of the Related Art

Conventionally, when a color registration adjustment process is to be performed to detect a superimposed state of images of different color components, it is determined whether a predetermined time has elapsed since a previous adjustment process, whether a predetermined number of images have been formed, whether environment has changed, and whether power on/off operation has been performed. Thereafter, when it is expected that the quality of an image to be formed may fail out of an appropriate range, a test image is formed and the quality of the test image is checked. When the quality of the test image is out of the appropriate range, the color registration adjustment process is performed.

For example, there is a disclosed technology for color registration adjustment, in which a color registration process is performed only when the quality of an image to be formed is likely to fall out of an appropriate range, in order to reduce wasteful consumption of a developer and the like and to efficiently adjust the color registration (see, for example, Japanese Patent Application Laid-open No. 2004-117384).

In the conventional color registration adjustment process as described above, the color registration process is performed when it is expected that the quality of an image to be formed may fall out of an appropriate range depending on the environment (temperature). However, if an image forming apparatus includes a plurality of writing units, temperature information of each writing unit is not taken into account when the color registration is adjusted. Therefore, the color registration adjustment process cannot appropriately be performed with consideration of a temperature difference between the writing units.

The present invention has been made in view of the above, and there is a need to provide a technology that enables an image forming apparatus having a plurality of writing units to accurately adjust color registration with consideration of a temperature difference between the writing units.

SUMMARY OF THE INVENTION

It is an object of the present invention to at least partially solve the problems in the conventional technology.

An image forming apparatus that includes an optical writing device for applying light corresponding to image data to form an image of the image data includes: a temperature detecting unit that detects temperature at a plurality of positions in the optical writing device; and an adjustment processing unit that, when a temperature difference between the positions detected by the temperature detecting unit is out of a predetermined range, forms a second image for quality verification and performs a process for adjusting color registration of the first image by using the second image.

An image forming method implemented in an image forming apparatus that includes an optical writing device for applying light corresponding to image data to form a first image of the image data includes: detecting, by a temperature detecting unit of the image forming apparatus, temperature at a plurality of positions in the optical writing device; forming, by an adjustment processing unit of the image forming apparatus, a second image for quality verification when a temperature difference between the positions detected at the detecting is out of a predetermined range; and performing, by the adjustment processing unit, a process for adjusting color registration of the first image by using the second image.

A computer program product includes a non-transitory computer-readable medium having computer-readable program codes embodied in the medium for a computer to form an image of image data by an image forming apparatus that includes an optical writing device for applying light corresponding to the image data. The program codes when executed causes the computer to execute: detecting, by a temperature detecting unit of the image forming apparatus, temperature at a plurality of positions in the optical writing device; forming, by an adjustment processing unit of the image forming apparatus, a second image for quality verification when a temperature difference between the positions detected at the detecting is out of a predetermined range; and performing, by the adjustment processing unit, a process for adjusting color registration of the first image by using the second image.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments will be explained in detail below with reference to the accompanying drawings.

Embodiment

Figure 1:
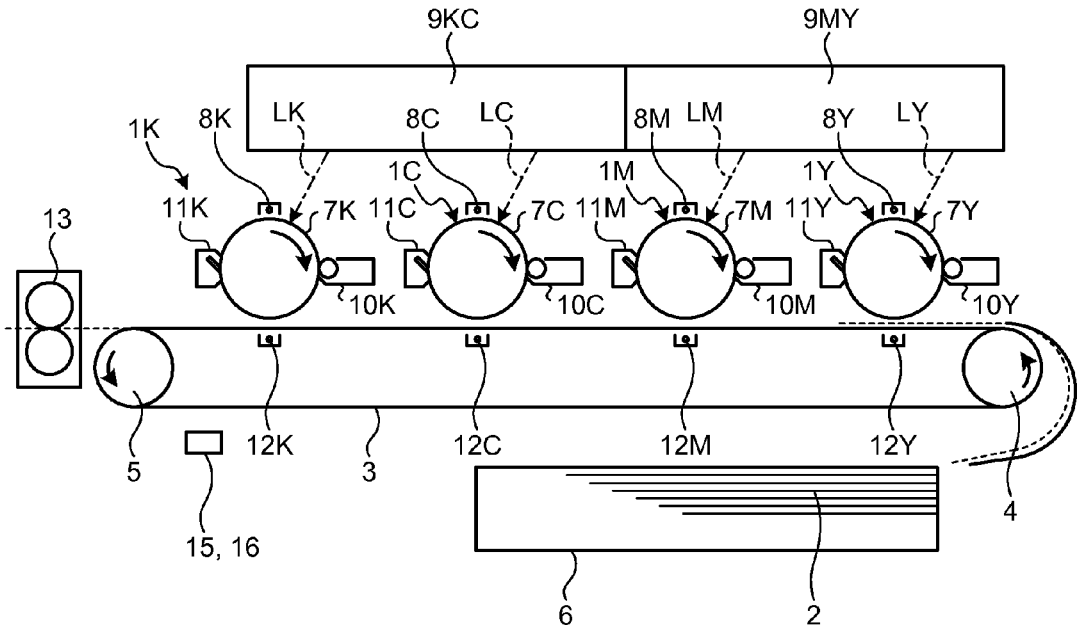
FIG. 1 is an explanatory diagram illustrating configurations of main parts of a color copying machine as an image forming apparatus.

A principle of image formation performed by a color copying machine is explained with reference to FIG. 1. FIG. 1 is an explanatory diagram illustrating configurations of main parts of the color printer serving as an image forming apparatus. In FIG. 1, an image processing unit, exposing units, and a transfer belt are specifically illustrated to explain the principle of the image formation. The color copying machine illustrated in FIG. 1 has a tandem structure and forms an image on a recording sheet through electrophotographic image formation.

The color copying machine is a tandem type that includes an image processing unit 1, in which four image forming units 1Y, 1M, 1C, and 1K that form images of different colors (Y: Yellow, K: Magenta, C: Cyan, and K: blacK) are linearly arranged along a transfer belt 3 that conveys a recording sheet 2 serving as a transfer medium. The transfer belt 3 is extended between a drive roller 4 that rotates and a driven roller 5 that is rotated, and is rotated in a direction of arrow in the figure along with the rotation of the drive roller 4. A paper feed tray 6 that houses the recording sheets 2 is placed below the transfer belt 3. When an image is formed, the topmost recording sheet 2 among the recording sheets 2 housed in the paper feed tray 6 is fed toward the transfer belt 3 and is electrostatically adsorbed onto the transfer belt 3. The adsorbed recording sheet 2 is conveyed to the image forming unit 1Y, where an image for the color of Y is formed as first image formation.

The image forming units 1Y, 1M, 1C, and 1K include photosensitive drums 7*y*, 7M, 7C, and 7K; charging units 8Y, 8M, 8C, and 8K, developing units 10Y, 10M, 10C, and 10K, photosensitive cleaners 11Y, 11M, 11C, and 11K, and transfer units 12Y, 12M, 12C, and 12K, which are arranged around the photosensitive drums 7Y, 7M, 7C, and 7K, respectively.

The charging unit 8Y uniformly charges the surface of the photosensitive drum 7Y of the image forming unit 1Y and an exposing unit 9MY exposes the charged surface with laser light LY corresponding to an image for the color of Y, so that an electrostatic image is formed. The developing unit 10Y develops the formed electrostatic image, so that a toner image is formed on the photosensitive drum 7Y. The transfer unit 12Y transfers the toner image onto the recording sheet 2 at a position (a transfer position) at which the photosensitive drum 7Y and the recording sheet placed on the transfer belt 3 are in contact with each other, so that a single color (the color of Y) image is formed on the recording sheet. After the transfer, the photosensitive cleaner 11Y clears residual toner remaining on the surface of the photosensitive drum 7Y in preparation for next image formation.

The transfer belt 3 conveys, to the image forming unit 1M, the recording sheet 2 on which the single color (the color of Y) image is transferred by the image forming unit 1Y as described above. The same image formation operation as the above operation for the color of Y is performed for the color of M, so that a toner image for the color of M is formed on the photosensitive drum 7M and then transferred and superimposed onto the recording sheet 2. The recording sheet 2 is further conveyed to the image forming unit 1C and the image forming unit 1K in sequence, the same image formation operation is performed to form toner images for the color of C and the color of K, and the toner images are transferred onto the recording sheet 2, so that a full-color image is formed on the recording sheet 2. The recording sheet 2, which has passed through the image forming unit 1K and on which the full-color toner image is formed, is separated from the transfer belt 3, is subjected to a fixing process due to the action of heat and pressure applied by a fixing unit 13, and is discharged.

In the color copying machine of the tandem type, position registration (correction of color misregistration) between colors is important because of its structure. The color misregistration between colors include misregistration in a main-scanning direction (a direction parallel to the rotation axes of the photosensitive drums 7K, 7M, 7C, and 7Y), misregistration in a sub-scanning direction (a direction perpendicular to the rotation axes of the photosensitive drums 7K, 7M, 7C, and 7Y), magnification error in the main-scanning direction, and skew (tilt). Therefore, in the color copying machine, color misregistration between colors is corrected by using color misregistration correction patterns 14 (see FIG. 2) before color images are actually formed on the recording sheet 2.

Figure 2:
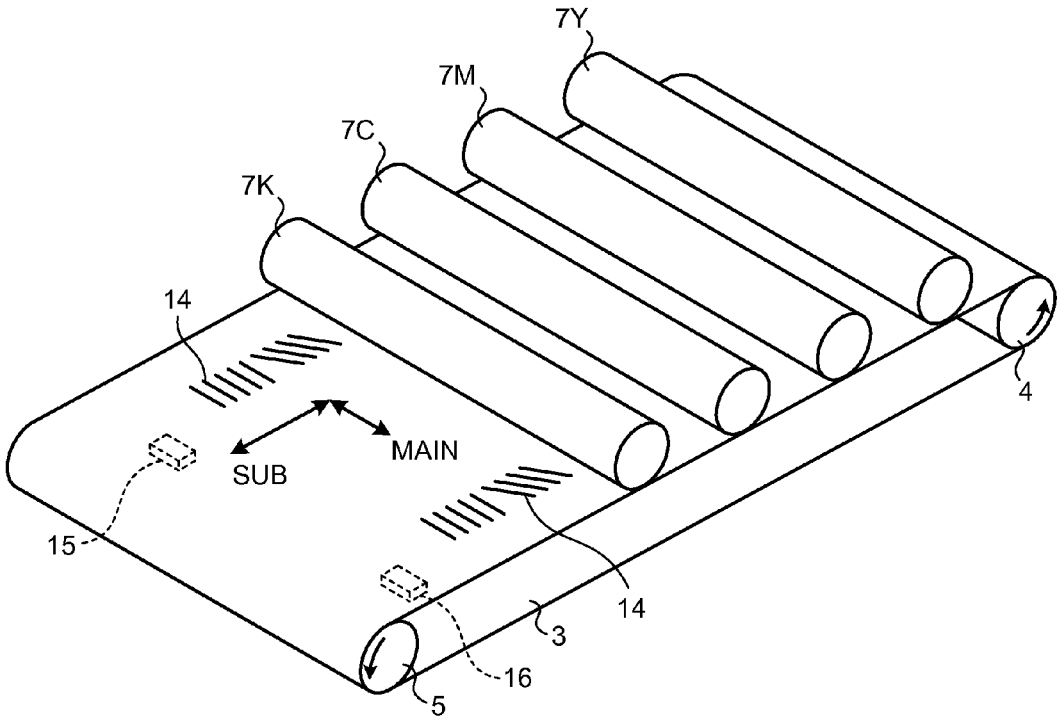
FIG. 2 is a perspective view of a transfer belt on which color misregistration correction patterns are formed.

FIG. 2 is a perspective view of the transfer belt on which the color misregistration patterns are formed. In the color copying machine, to correct color misregistration, the image forming units 1Y, 1M, 1C, and 1K form the color misregistration correction patterns 14 for the respective colors on the transfer belt 3, and pattern detection sensors 15 and 16 detect the color misregistration correction patterns 14. In the example in FIG. 2, the pattern detection sensors 15 and 16 are arranged at opposite end portions of the transfer belt 3 in the main-scanning direction, and the color misregistration correction patterns 14 are formed at positions corresponding to the placement positions of the pattern detection sensors 15 and 16. The color misregistration correction patterns 14 are detected when they sequentially pass by the pattern detection sensors 15 and 16 along with the movement of the transfer belt 3 in a conveying direction as illustrated in the figure. When the color misregistration correction patterns 14 are detected, a calculation process is performed to calculate various color misregistration amounts (an amount of magnification error in the main-scanning direction, an amount of misregistration in the main-scanning direction, an amount of misregistration in the sub-scanning direction, an skew amount, and an amount of distortion), and a correction amount of each misregistration component is calculated from the color misregistration amounts.

Figure 3:
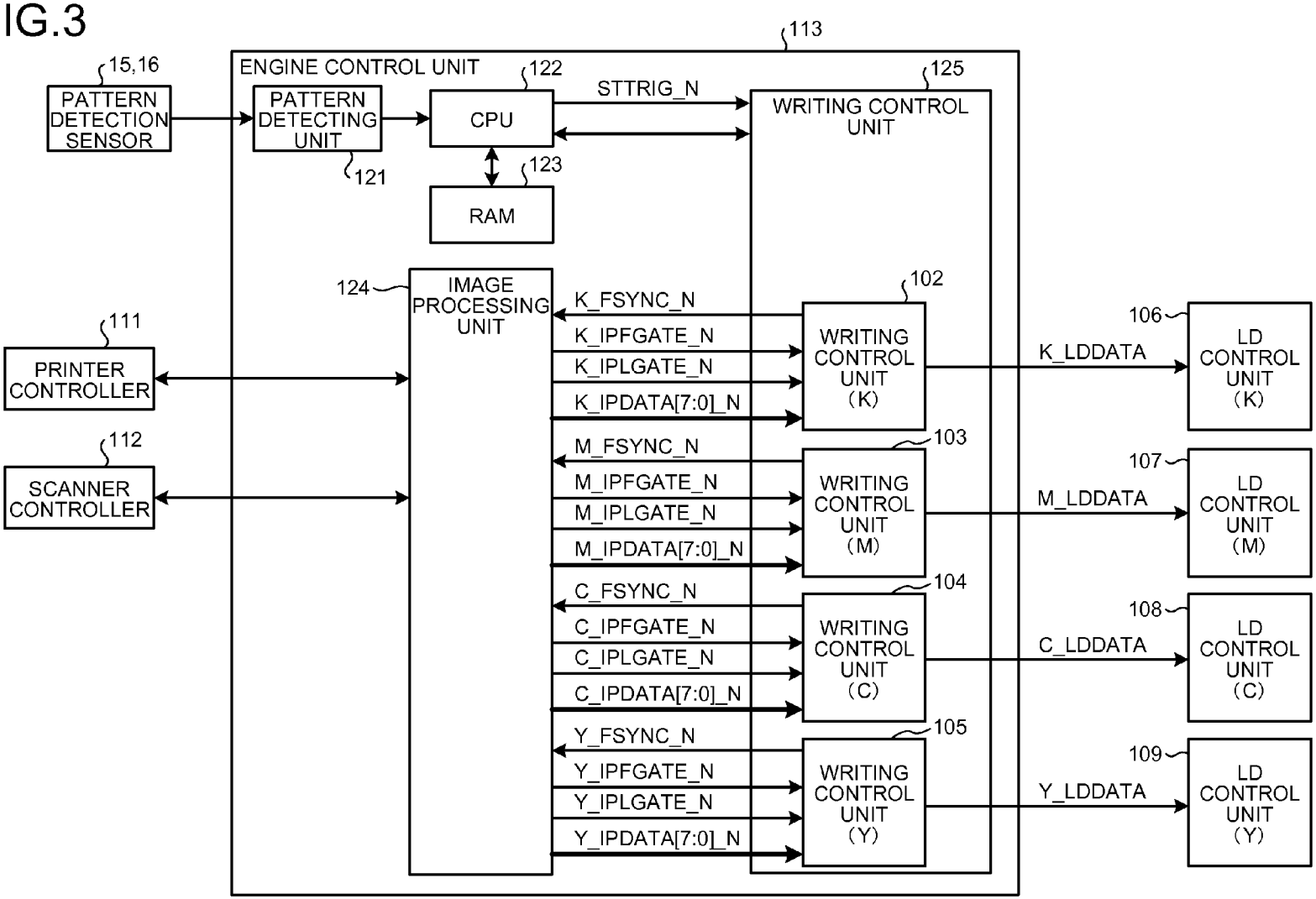
FIG. 3 is a block diagram illustrating a configuration example of a mechanism that controls writing and corrects color misregistration in the color copying machine.

With reference to FIG. 3, an explanation is given of blocks and control operation related to writing control and color misregistration correction performed by the color copying machine. FIG. 3 is a block diagram illustrating a configuration example of a mechanism that controls writing and corrects color misregistration in the color copying machine. A processing unit that corrects color misregistration in the color copying machine includes the pattern detection sensors 15 and 16, a printer controller 111, a scanner controller 112, an engine control unit 113, and laser diode (LTD) control units 106, 107, 108, and 109 for respective colors of K, M, C, and Y. The engine control unit 113 includes a writing control unit (K) 102, a writing control unit (M) 103, a writing control unit (C) 104, and a writing control unit 105 for controlling writing for the respective colors.

The pattern detection sensors 15 and 16 detect the color misregistration correction patterns 14 and density deviation correction patterns 14 transferred on the transfer belt 3 to calculate a color misregistration amount and a density deviation amount between the colors. The pattern detection sensors 15 and 16 detect the color misregistration correction patterns 14 and the density deviation correction patterns and output an analog detection signal to the engine control unit 113.

The printer controller 111 receives image data that is transmitted from an external apparatus (e.g., a personal computer (PC)) via a network, and transfers the received image data to an image processing unit 124. The scanner controller 112 acquires image data of an original that is read by a scanner (not illustrated), and transfers the acquired image data to the image processing unit 124.

The engine control unit 113 mainly includes a pattern detecting unit 121, a central processing unit (CPU) 122, a random access memory (RAM) 123, the image processing unit 124, and a writing control not 125.

The pattern detecting unit 121 amplifies the detection signal output from the pattern detection sensors 15 and 16, converts the amplified analog detection signal into digital data, and stores the converted digital data in the RAM 123.

The CPU 122 calculates a color misregistration amount from the digital data stored in the RAM 123 and calculates a correction amount for correcting the calculated color misregistration amount. The color misregistration amount includes the amount of distortion, the amount of magnification error in the main-scanning direction, the amount of misregistration in the main-scanning direction (hereinafter, described as the main misregistration amount), the amount of misregistration in the sub-scanning direction (hereinafter, described as the sub misregistration amount), and the skew amount, between the colors. The correction amount includes a correction amount of distortion, a correction amount of main-scanning magnification, a correction amount of registration in the main-scanning direction (hereinafter, described as a main registration correction amount), a correction amount of registration in the sub-scanning direction (hereinafter, described as a sub registration correction amount), and a skew correction amount.

The CPU 122 calculates amounts of distorted lines for the colors of Y, M, and C with respect to the color of K that serves as a reference color, on the basis of the resolution of the image data and the calculated amounts of distortion of the respective colors (Y, M, C, and K). The CPU 122 also determines the number of lines of the line memory on the basis of the amounts of distorted lines for the colors of Y, M, and C with respect to the color of K serving as the reference color. The reference color is a color that is used as a reference position when the amounts of distorted lines for the colors other than the color of K are calculated. In this example, K is used as the reference color.

The RAM 123 temporarily stores therein digital data of the color misregistration correction patterns 14 acquired from the pattern detecting unit 121 via the CPU 122. The RAM 123 may be replaced with a nonvolatile memory, and the digital data of the color misregistration correction patterns 14 may be stored in the nonvolatile memory. The RAM 123 also stores therein history information on past temperature detection results, and the information is used for a color registration process to be described later.

The image processing unit 124 performs various image processes depending on image data received by the printer controller 111 or image data acquired by the scanner controller 112. The image processing unit 124 also receives sub-scanning timing signals (K, M, C, and Y)_FSYNC_N for the respective colors transmitted from the writing control unit 125, and transmits main-scanning gate signals (K, M, C, and Y)_IPLGATE_N, sub-scanning gate signals (K, M, C, and Y)_IPFGATE_N, and piece of image data (K, M, C, and Y)_IPDATA_N associated with the above synchronous signals to the writing control unit 125.

The writing control unit 125 receives the image data (K, M, C, and Y)_IPDATA_N transferred by the image processing unit 124, performs various writing processes on the received pieces of image data (K, M, C, and Y)_IPDATA_N to thereby generate pieces of LD light emission data (K, M, C, and Y)_LDDATA, and transmits the pieces or LD light emission data (K, M, C, and Y)_LDDATA to the respective LD control units 106, 107, 108, and 109.

Each of the LD control units 106, 107, 108, and 109 is provided in an exposing unit 9KC or the exposing unit 9MY (see FIG. 1), and controls application of laser lights KY, LM, LC, and LK from the exposing units 9KC and 9MY to the photosensitive drums 7Y, 7M, 7C, and 7K. With the application of the laser lights LY, LM, LC, and LK, electrostatic latent images are formed on the photosensitive drums 7Y, 7K, 7C, and 7K. Thereafter, a developing process is performed on the electrostatic latent images to form toner images. The formed toner images are transferred on and fixed to the recording sheet 2, and the recording sheet 2 is subsequently discharged.

An overview of a color image formation process performed by the color copying machine is explained below. The printer controller 111 processes image data transmitted by the PC and the scanner controller 112 processes image data of an original read by the scanner (not illustrated), and each piece of the image data is transferred to the image processing unit 124 of the engine control unit 113. The image processing unit 124 performs various image processes corresponding to the image data to convert the image data into pieces of image data of respective colors, and the pieces of image data are transferred to the writing control unit 125. The writing control unit 125 generates print timing for each color, receives pieces of image data at sub-scanning timing, performs various image processes on the received image data to generate pieces of LD light emission data, and applies the laser lights LY, LM, LC, and LK by the LD control units 106, 107, 108, and 109 for the respective colors thereby to form images on the photosensitive drums 7Y, 7M, 7C, and 7K.

Figure 4:
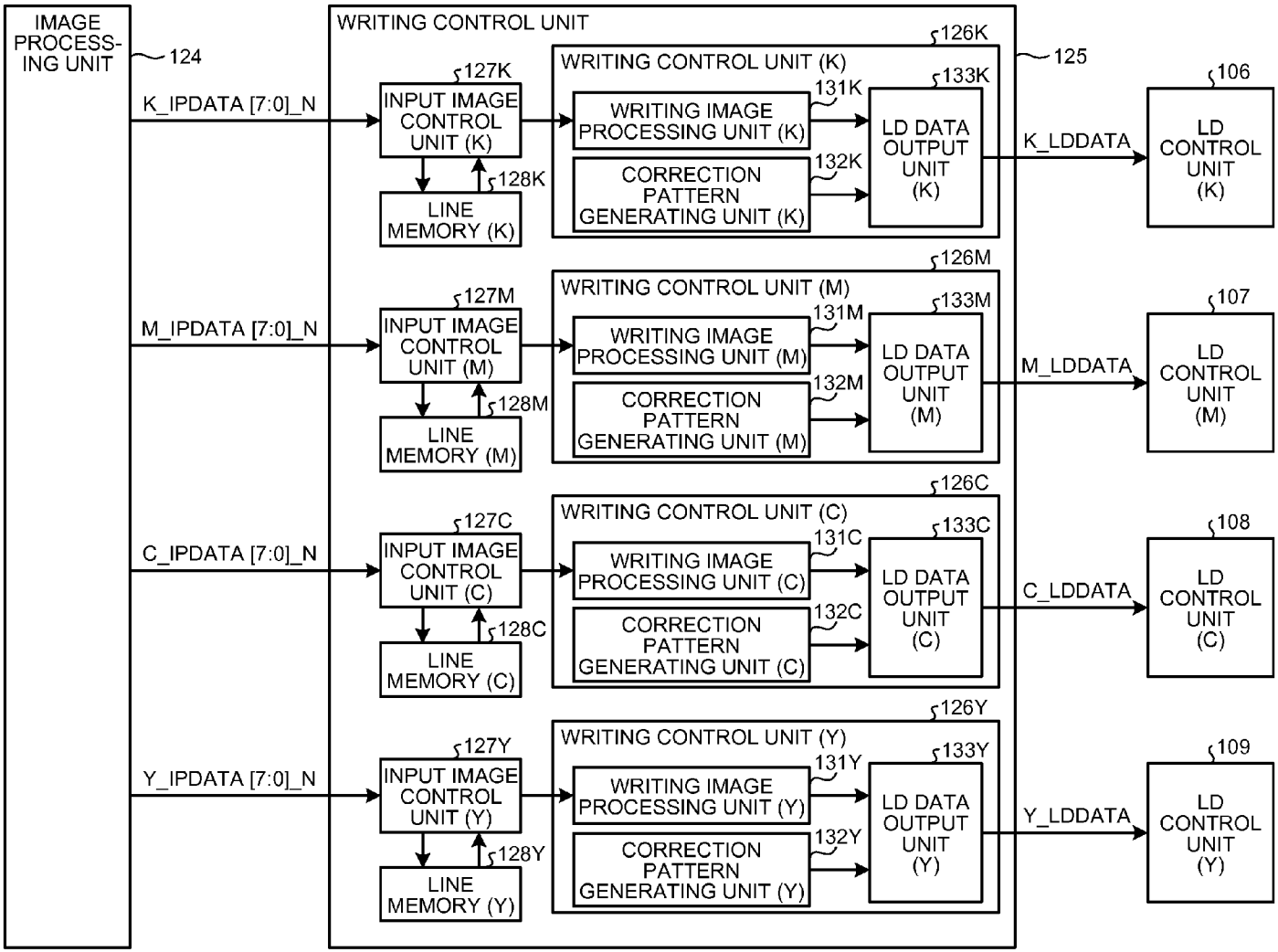
FIG. 4 is a block diagram illustrating a configuration example of the writing control unit.

The writing control unit 125 in the engine control unit 113 is described in detail below with reference to FIG. 4. FIG. 4 is a block, diagram illustrating a configuration example of the writing control unit. The writing control unit 125 mainly includes writing control units 126K, 126M, 126C, and 126Y, input-image control units 127K, 127M, 127C, and 127Y, and line memories 128K, 128M, 128C, and 128Y, for the respective colors of K, M, C, and Y.

The input-image control units 127K, 127M, 127C, and 127Y receive image data transmitted by the image processing unit 124, store the received image data in the line memories 128K, 128M, 128C, and 128Y, and sequentially read the stored image data and transfer the image data to the writing control units 126K, 126M, 126C, and 126Y, respectively.

The input-image control units 127K, 127M, 127C, and 127Y store the image data in the line memories 128K, 128M, 128C, and 128Y for the respective colors on the basis of the amounts of distorted lines calculated by the CPU 122. In the embodiment, each of the input-image control units 127K, 127M, 127C, and 127Y receives image data of a binary image with a single bit per pixel from the image processing unit 124, and transfers the received image data to a corresponding one of the writing control units 126K, 126M, 126C, and 126Y.

While the image data of the binary image is transferred to the writing control units 126K, 126M, 126C, and 126Y in the embodiment, the embodiment is not limited thereto. For example, it is possible to convert the image data of the binary image into image data with concentration in 4-bit values (0 (=white pixel) to 15 (=black pixel)) and transfer the converted image data to the writing control units 126K, 126M, 126C, and 126Y.

The line memories 128K, 128M, 128C, and 1281' sequentially store pieces of image data transferred by the image processing unit 124. The writing control unit 126K for the color of K serving as the reference color includes a writing-image processing unit 131K, a correction-pattern generating unit 132K, and an LD-data output unit 133K. The writing control units 126M, 126C, and 126Y for the other colors of K, C, and Y include writing-image processing units 131M, 131C, and 131Y, correction-pattern generating units 132M, 132C, and 132Y, and LD-data output units 133M, 133C, and 133Y, respectively, which have the same configurations as the units for the color of K.

In FIG. 4, for simplicity of explanation, three signals, i.e., the main-scanning gate signals (K, M, C, and Y)_IPLGATE_N, the sub-scanning gate signals (K, M, C, and Y)_IPFGATE_N, and image data (K, M, C, Y)_IPDATA_N associated with the synchronous signals, are collectively described as writing control signals (K, m, C, and Y)_IPDATA[7:0]_N.

The writing-image processing units 131K, 131M, 131C, and 131Y perform various image processes by using image data stored in the line memories 128K, 128K, 128C, and 128Y, respectively.

The correction pattern generating units 132K, 13214, 132C, and 132Y generate the color misregistration correction patterns 14 and the density deviation correction patterns 14 on the transfer belt 3 for correcting color misregistration and density deviation between the colors, and outputs the color misregistration correction patterns 14 and the density deviation correction patterns 14, that have been generated, via the LD-data output units 133K, 133M, 133C, and 133Y, respectively. Thus, the color misregistration correction patterns 14 and the density deviation correction patterns 14 are formed on the transfer belt 3.

The LD-data output units 133K, 133M, 133C, and 133Y send corrected writing commands (LD-light emission data (K, K, C, and Y)_LDDATA) to the LD control units 106, 107, 108, and 109, respectively, on the basis of the main/sub registration correction amounts calculated by the CPU 122, to thereby control correction of the difference in the writing timing related to the laser light emission. The LD-data output units 133K, 133M, 133C, and 133Y send image-frequency change commands (LD-light emission data (K, M, C, and Y)_LDDATA) corresponding to the correction amount of main-scanning magnification calculated by the CPU 122 to the LD control units 106, 107, 108, and 109, respectively, to thereby control correction of the magnification error in the main-scanning direction. The LD-data output units 133K, 133M, 133C, and 133Y send, to the LD control units 106, 107, 108, and 109, commands (LD-light emission data (K, M, C, and Y)_LDDATA) to form the color misregistration correction patterns 14 and the density deviation correction patterns 14 obtained from the correction-pattern generating units 132K, 132M, 132C, and 132Y on the transfer belt 3. Each of the LD-data output units 133K, 133M, 133C, and 133Y includes a device capable of performing fine setting of an output frequency, e.g., a clock generator equipped with a voltage controlled oscillator (VCO), for a corresponding color.

Image writing processes performed by the writing control units 126K, 126M, 126C, and 126Y are explained in detail below. The image writing process for the color of K in FIG. 3 is first explained. Image data K_IPDATA[7:0]_N is transmitted from the image processing unit 124 to the input-image control unit 127K. The input-image control unit 127K temporarily stores the image data in the line memory 128K, and transmits the image data to the writing control unit 126K. In the writing control unit 126K, the writing-image processing unit 131K sends the image data that has been transmitted by the input-image control unit 127K to the LD-data output unit 133K. The LD-data output unit 133K generates writing LD-light emission data K_LDDATA for the color of K, and sends the generated data to the LD control unit 106. When the color misregistration correction patterns 14 and the density deviation correction patterns 14 are output, the correction pattern generating units 132K, 132W, 132C, and 132Y transmit pieces of image data for the respective colors of K, M, C, and Y to the LD-data output units 133K, 133M, 133C, and 133Y, respectively. Thereafter, the same operations as described above are performed.

Figure 5:
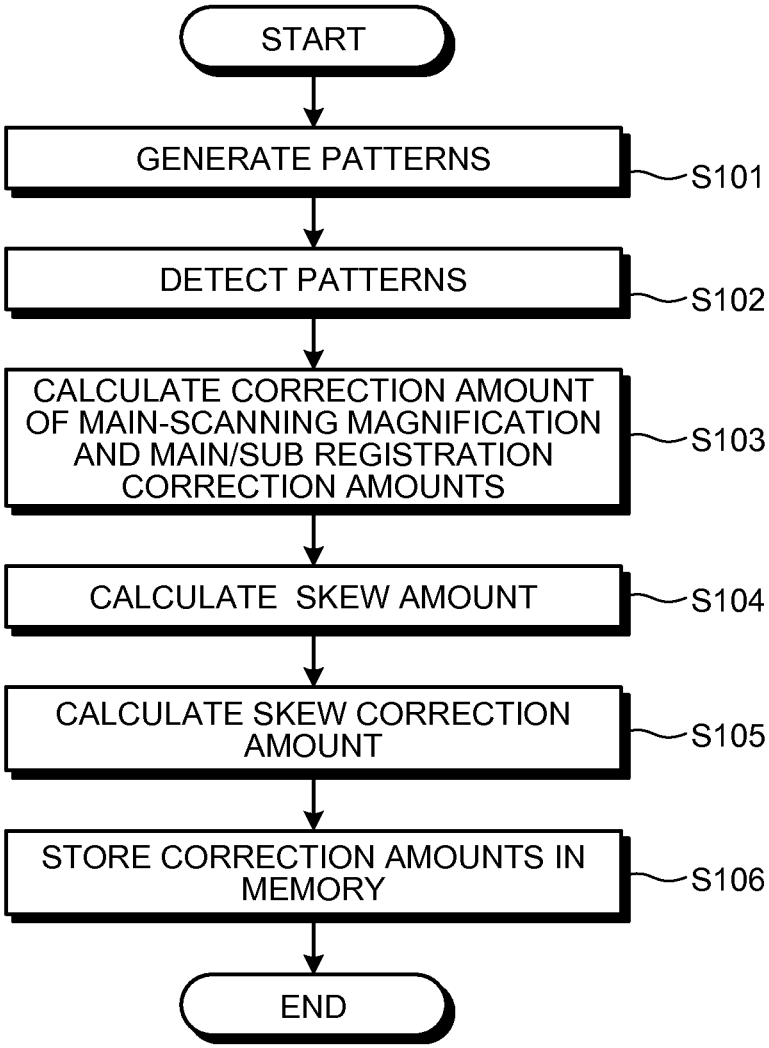
FIG. 5 is a flowchart of a flow of processes for calculating a color-misregistration correction amount.

A flow of a process for calculating a color-misregistration correction amount for each of the colors of K, M, C, and Y is explained below with reference to FIG. 5. FIG. 5 is a flowchart illustrating a flow of the process for calculating the color-misregistration correction amount. In the following explanation, an example is explained in which the color of K is used as the reference color. The reference color is a color to be used as a reference in aligning positions. Specifically, the colors other than the reference color are adjusted with respect to the reference color so as to correct color misregistration between the colors. The control operation illustrated in the flowchart of FIG. 5 is performed in an integrated manner by the engine control unit 113.

When the process for calculating the color-misregistration correction amount is started, the color misregistration correction patterns 14 generated by the correction pattern generating units 132K, 132M, 132C, and 132Y for correcting the misregistration of the respective colors are formed on the transfer belt 3 (Step S101). Subsequently, the pattern detection sensors 15 and 16 detect the color misregistration correction patterns 14 formed on the transfer belt 3 (Step S102).

The pattern detecting unit 121 converts a detection signal of the color misregistration correction patterns 14 detected by the pattern detection sensors 15 and 16 into digital data, and the CPU 122 calculates the correction amount of main-scanning magnification and the main/sub registration correction amounts with respect to the reference color (K) based on the digital data of the color misregistration correction patterns 14 (Step S103). At the same time, the CPU 122 calculates the skew amount of each color with respect to the reference color (K) (Step S104), and further calculates a skew correction amount for correcting the skew (Step S105).

The CPU 122 stores the correction amounts including the calculated correction amount of main-scanning magnification, the main/sub registration correction amounts, and the skew correction amount in a memory, such as the RAM 123 (or the nonvolatile memory), and thereafter, the color misregistration correction process is terminated (Step S106). The correction amounts stored in the RAM 123 are used as the correction amounts at the time of printing until a next color misregistration correction process is performed. As described above, after the correction amount of main-scanning magnification, the main/sub registration correction amounts, and the skew correction amount are stored in the RAM 123, a printing process is performed.

Figure 6:
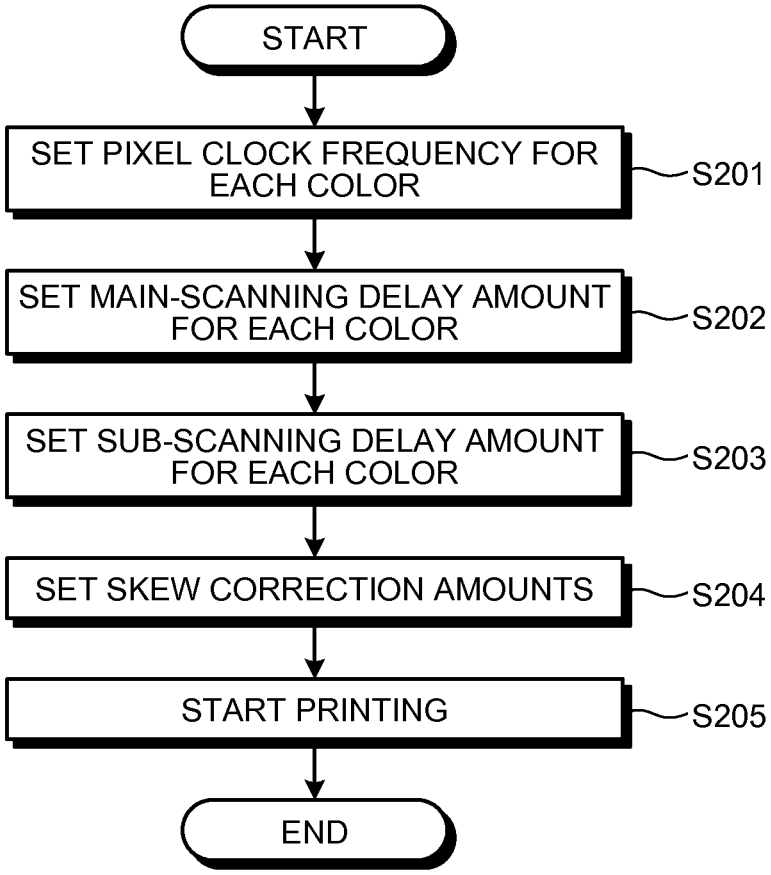
FIG. 6 is a flowchart showing a flow of a printing process.

FIG. 6 is a flowchart showing a flow of the printing process. The control operation illustrated in the flowchart of FIG. 6 is performed in an integrated manner by the engine control unit 113. When the printing process is started, the writing control unit 125 sets a pixel clock frequency for each of the colors of K, M, C, and Y on the basis of the correction amounts of main-scanning magnification stored in the RAM 123 (Step S201). Subsequently, the writing control unit 125 sets a main-scanning delay amount for each color on the basis of the main registration correction amounts stored in the RAM 123 (Step S202). Furthermore, the writing control unit 125 sets a sub-scanning delay amount for each color on the basis of the sub registration correction amounts stored in the RAM 123 (Step S203).

Thereafter, the writing control unit 125 sets a skew correction amount for each of the M, C, and Y colors with respect to the reference color (K) on the basis of the skew correction amount and information on the number of gradation, which are stored for each color in the RAM 123 (Step S204). Then, the writing control unit 125 starts printing while correcting color misregistration on the basis of the main-scanning pixel clock frequency, the main-scanning delay amount, the sub-scanning delay amount, and the skew correction amount for each of the colors of K, M, C, and Y, and thereafter, the printing process is terminated (Step S205).

Color misregistration in the main-scanning direction is corrected by correcting the main-scanning magnification and the writing timing in the main-scanning direction. The main-scanning magnification is corrected by changing an image frequency based on the amount of magnification error that is detected for each color by the writing control unit 125. The writing control unit 125 includes a device that can perform fine setting of the frequency, e.g., a clock generator using a VCO. The writing timing in the main-scanning direction is adjusted in accordance with a position at which an LD outputs data from a main-scanning counter that operates by using the synchronous detection signal for each color as a trigger. Correction of the color misregistration in the sub-scanning direction is performed by causing the writing control unit 125 to correct the writing timing in the sub-scanning direction.

Figure 7:
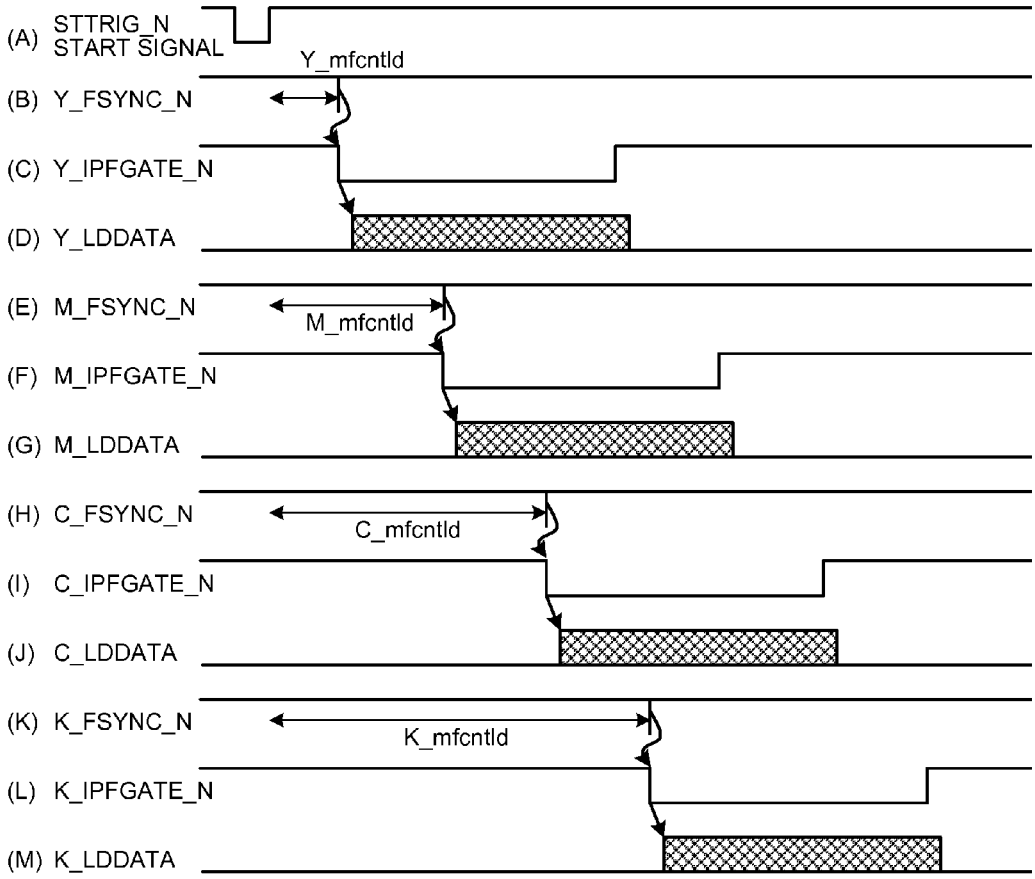
FIG. 7 is a timing chart illustrating an example of correction of writing timing in a sub-scanning direction.

FIG. 7 is a timing chart illustrating an example of correction of the writing timing in the sub-scanning direction. In FIG. 7, denotes a start signal, i.e., STTRIG_N; (B) denotes a sub-scanning timing signal for the color of Y, i.e., Y_FSYNC_N; (C) denotes a sub-scanning gate signal for the color of Y, i.e., Y_IPFGATE_N; (D) denotes LD light emission data for the color of Y, i.e., Y_LDDATA; (E) denotes a sub-scanning timing signal for the color of N, i.e., M_FSYNC_N; (F) denotes a sub-scanning gate signal for the color of N, i.e., M_IPFGATE_N; (G) denotes LD light emission data for the color of N, i.e., M_LDDATA; (H) denotes a sub-scanning timing signal for the color of C, i.e., C_FSYNC_N; (I) denotes a sub-scanning gate signal for the color of C, i.e., C_IPFGATE_N; (J) denotes LD light emission data for the color of C, i.e., C_LDDATA; (K) denotes a sub-scanning timing signal for the color of K, i.e., K_FSYNC_N; (L) denotes a sub-scanning gate signal for the color of K, i.e., K_IPFGATE_N; and (M) denotes LD light emission data for the color of K, i.e., K_LDDATA.

As illustrated in FIG. 7, the writing control unit. 125 counts the number of lines with reference to the start signal STTRIG_N sent from the CPU 122, and transmits the sub-scanning timing signals (Y, M, C, and K)_FSYNC_N for the respective colors to the image processing unit 124.

The image processing unit 124 uses the reception of the sub-scanning timing signals (Y, M, C, and K)_FSYNC_N for the respective colors as a trigger, transmits the sub-scanning gate signals (Y, N, C, and K)_IPFGATE_N for the respective colors to the writing control unit 125, and transmits the image data (Y, MS, C, and K)_IPDATA[7:0]_N for the respective colors. The writing control units 126Y, 126M, 126C, and 126K for the respective colors transmit the pieces of LD-light emission data (Y, M, C, and K)_LDDATA for the respective colors to the LD control units 106, 107, 108, and 109.

When color misregistration in the sub-scanning direction is to be corrected, the sub-scanning delay amounts (Y, N, C, and K)_mfcntld from the start signal are changed in accordance with the detected color misregistration amounts. Usually, the color misregistration amounts with reference to the color at K are reflected in the sub-scanning delay amounts for the colors of N, C, and Y (M, C, and K)_mfcntld, and timing of the sub-scanning timing signals (I, N, C, and K)_FSYNC_N for the respective colors are changed to correct the color misregistration in the sub-scanning direction.

Figure 8:
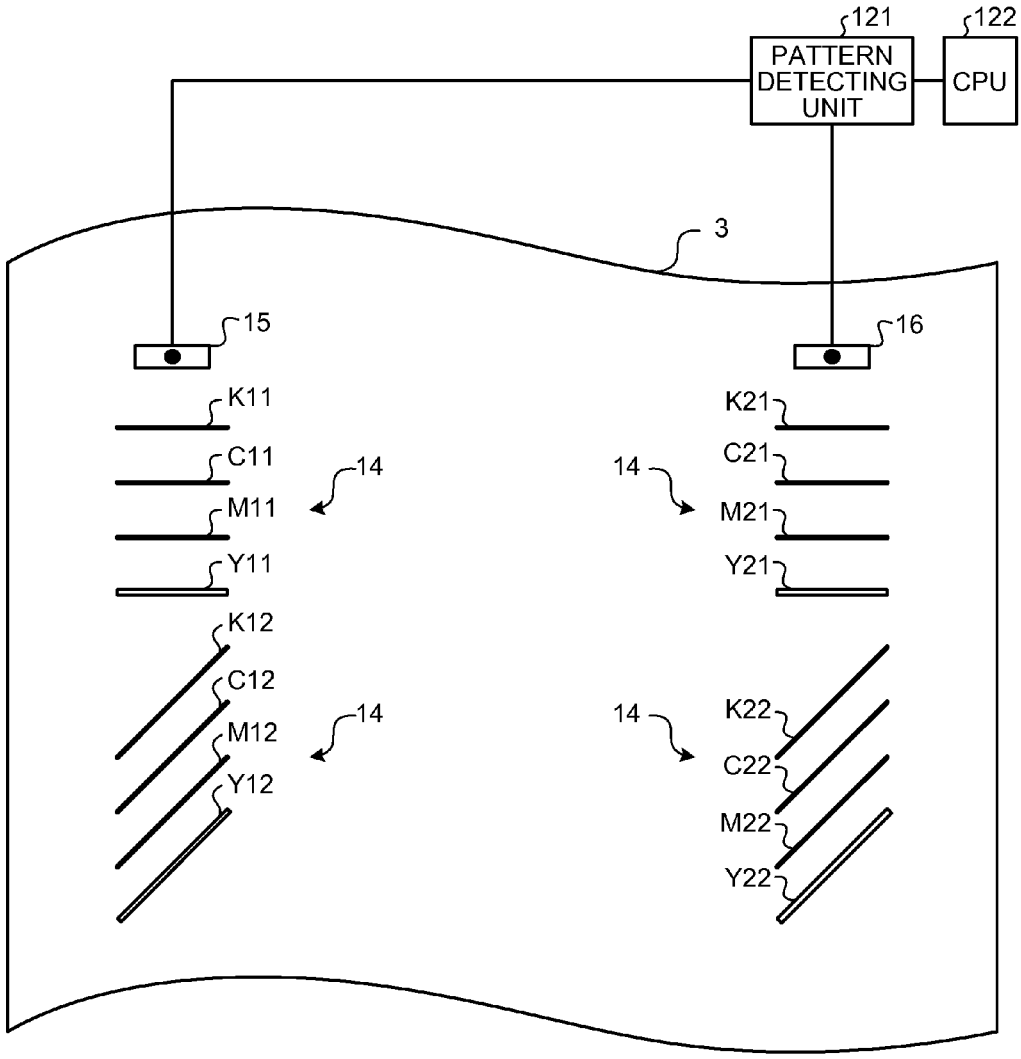
FIG. 8 is an explanatory diagram illustrating an example of the color misregistration correction patterns formed on the transfer belt.

FIG. 8 is an explanatory diagram illustrating an example of the color misregistration correction patterns formed on the transfer belt 3. The color misregistration correction patterns 14 contain four parallel patterns K11, C11, M11, Y11, four parallel patterns K21, C21, M21, and Y21, four oblique patterns K12, C12, M12, Y12, and four oblique patterns K22, C22, M22, and Y22, which are arranged at constant intervals in the sub-scanning direction. The color misregistration correction patterns 14 as described above are repeatedly formed in the moving direction of the transfer belt 3. The color misregistration correction patterns 14 are output a plurality of times in accordance with the positions of the pattern detection sensors 15 and 16 as illustrated in FIG. 8 in order to increase the number of samples so as to reduce the influence of errors.

The color misregistration correction patterns 14 formed on the transfer belt 3 are detected by the pattern detection sensors 15 and 16. The pattern detecting unit 121 converts a detection signal output by the pattern detection sensors 15 and 16 from analog data to digital data. The CPU. 122 performs sampling of the digital data converted by the pattern detecting unit 121 and stores the sampled digital data in the RAM 123. When a series of detection of the color misregistration correction patterns 14 is finished, the CPU 122 performs calculation processes for calculating various color misregistration amounts (the amount of distortion, the amount of magnification error in the main-scanning direction, the main/sub misregistration amounts, and the skew amount, for each color) by using the digital data stored in the RAM 123, and then calculates the correction amount of each misregistration component from the color misregistration amounts.

Figure 9:
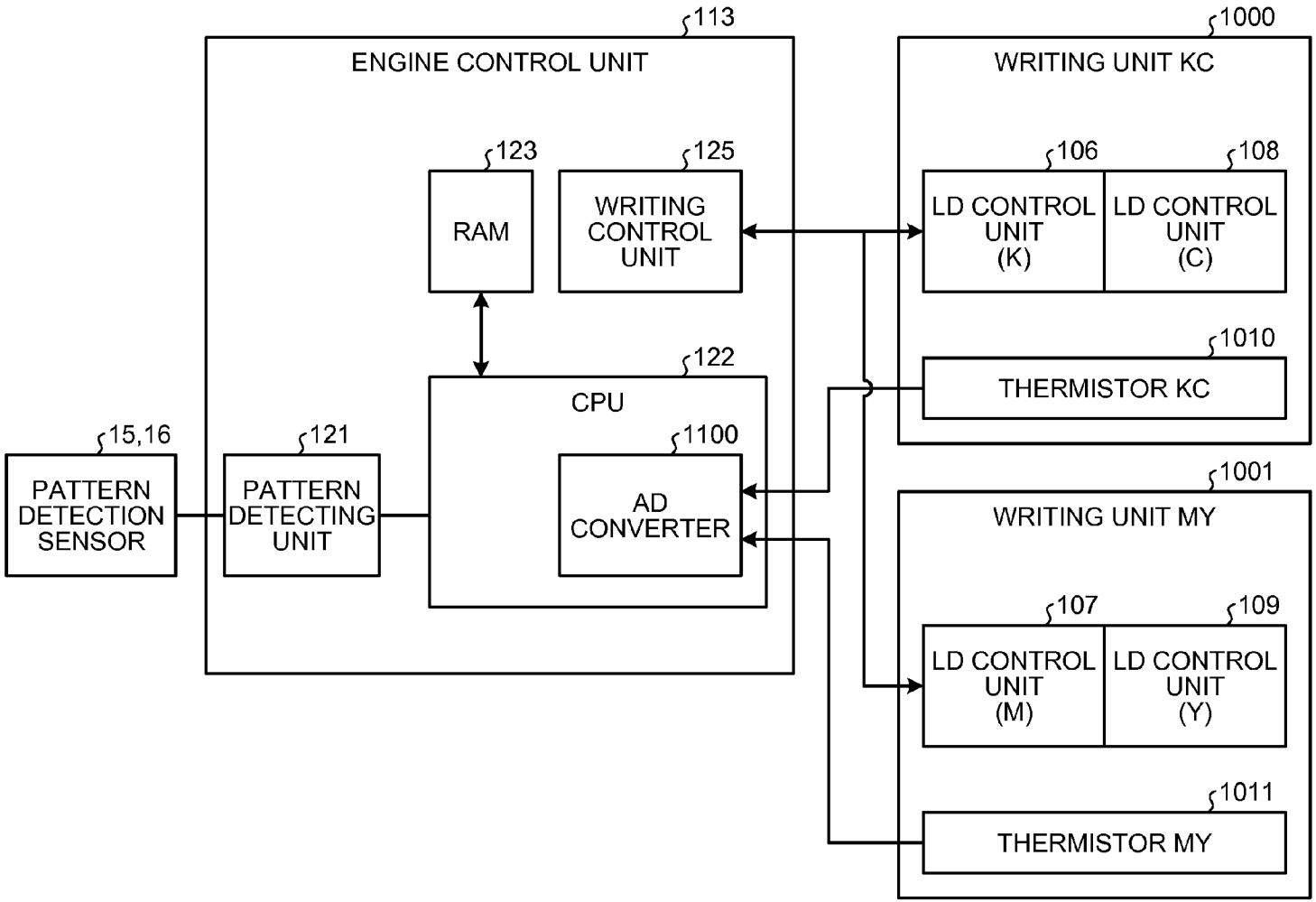
FIG. 9 is a block diagram illustrating a configuration example in which a writing unit KC and a writing unit MY are separately provided.

FIG. 9 is a block diagram illustrating a configuration example in which a writing unit KC and a writing unit MY are separately provided. In the example in FIG. 9, a writing unit KC 1000 and a writing unit. MY 1001 are provided independently of each other. The writing units for KC and MY are separately provided such that the writing unit KC 1000 includes a thermistor KC 1010 and the writing unit MY 1001 includes a thermistor MY 1011 in order to detect temperature of each unit.

The CPU 122 includes an AD converter 1100 that converts analog data into digital data. The AD converter 1100 converts analog signals detected by the thermistor KC 1010 and the thermistor MY 1011 into digital data, and the converted digital data is stored in the RAM 123. The RAM 123 temporarily or therein digital data of temperature information acquired from the thermistor KC 1010 and the thermistor MY 1011 via the CPU 122. The RAM 123 may be replaced with a nonvolatile memory, and the digital data of the temperature information may be stored in the nonvolatile memory.

Figure 10:
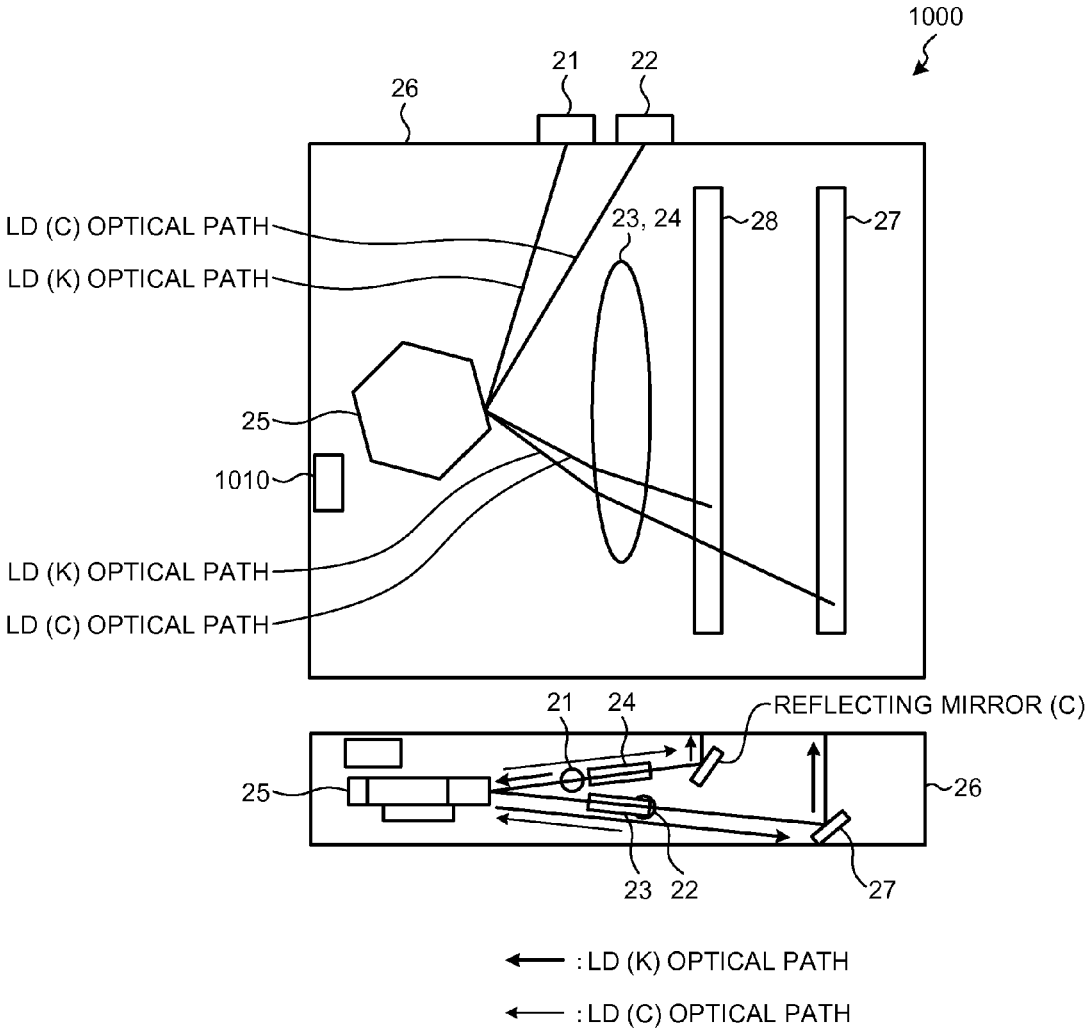
FIG. 10 is a cross-sectional view of the writing unit KC illustrated in FIG. 9 taken in a main-scanning direction.

FIG. 10 is a cross-sectional view of the writing unit KC 1000 illustrated in FIG. 9, taken in the main-scanning direction. In FIG. 10, a reference numeral 21 denotes an LD (K), a reference numeral 22 denotes an LD (C), a reference numeral 23 denotes an fθ lens for the LD (K), a reference numeral 24 denotes an fθ lens for the LD (C), a reference numeral 25 denotes a polygon mirror (KC), a reference numeral 26 denotes a housing, a reference numeral 27 denotes a reflecting mirror (K), a reference numeral 28 denotes a reflecting mirror (C), and the reference numeral 1010 denotes a thermistor (KC).

The LD (K) 21 and the LD (C) 22 are light source units that emit light beams. For example, each of the LD (K) 21 and the LD 22 includes a laser emitting unit formed by a semiconductor laser, and also includes a collimator lens. The LD (K) 21 and the LD 22 emit light beams toward the same deflecting plane of the polygon mirror 25 that is a deflecting unit, at different angles within the cross section in the sub-scanning direction. The fθ lens that is a scanning lens of an image focusing unit includes two fθ lenses having fθ characteristics. The fθ lens 23 for the LD (K) is arranged at a lower portion and the fθ lens 24 for the LD (C) is arranged at an upper portion. The two fθ lenses are arranged so as to correspond to light beams respectively emitted from the LD (K) 21 and the LD (C) 22 serving as the two light source units. The light beams deflected and reflected by the polygon mirror 25 are focused on different positions of a scanning surface. The polygon mirror 25 is the deflecting unit that reflects the light beams which are applied by the light source units at the deflecting plane toward the image focusing unit.

Specifically, the light beams that are obliquely applied from the LD (K) 21 and the LD (C) 22 are reflected at the same deflecting plane of the polygon mirror 25 and the reflected light beams are respectively applied to the fθ lens 23 for the LD (K) and the fθ lens 24 for the LD (C). The polygon mirror 25 is rotated counterclockwise at a predetermined speed by a motor (not illustrated) serving as a driving unit. The housing 26 houses various devices that form a scanning optical device. The reflecting mirror (K) 27 and the reflecting mirror (C) 28 reflect the light beams, which have been deflected by the polygon mirror (KC) 25 and passed through the fθ lens 23 for the LD (K) and the fθ lens 24 for the LD (C), so that the light beams are focused on different exposing positions of the scanning surface. An LD (K) optical path enters the polygon mirror 25 from the optical path of the LD (K) 21, is deflected and reflected by the polygon mirror 25, and is reflected by the corresponding reflecting mirror (K) 27 via the fθ lens 23 for the LD (K) so as to scan the scanning surface. An LD (C) optical path is also used to scan the scanning surface in the same manner as above, via the polygon mirror 25, the fθ lens 24 for the LD (C), and the reflecting mirror (C) 28. The thermistor KC 1010 detects the temperature of the scanning optical device.

In the writing configuration illustrated in FIGS. 9 and 10, the writing units are separated for KC and MY, and only the polygon motor for KC is rotated during monochrome printing. During the monochrome printing, the polygon motor (KC) 25 is rotated, so that the temperature of the writing unit KC 1000 increases. On the other hand, because the polygon motor MY is stopped, the temperature of the writing unit MY 1001 does not increase.

Figure 11:
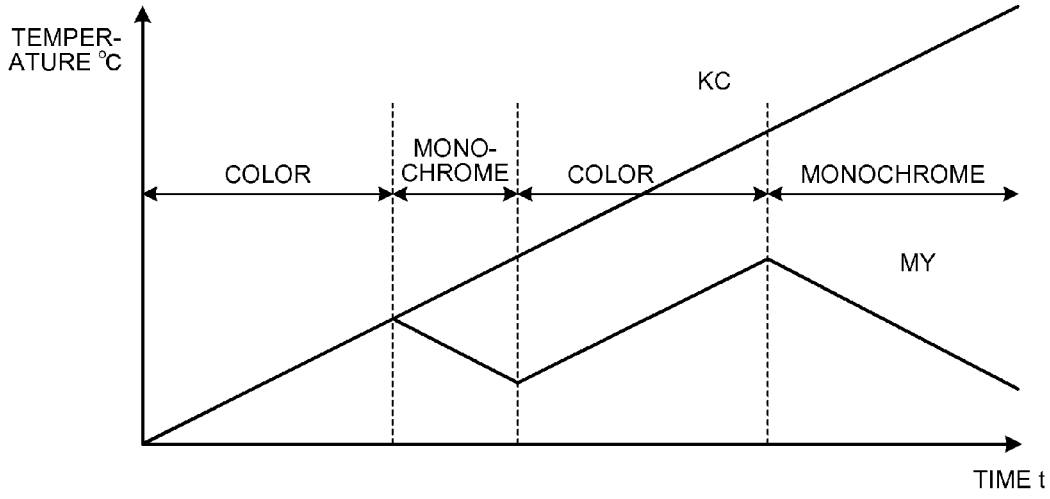
FIG. 11 is a graph illustrating an example of a change in the temperature of each of the writing unit KC and the writing unit MY when color printing and monochrome printing are repeated.

FIG. 11 is a graph illustrating an example of a change in the temperature of each of the writing unit KC 1000 and the writing unit MY 1001 when color printing and monochrome printing are repeated. When the color printing is performed, because the polygon motors for the writing unit KC 1000 and the writing unit MY 1001 are rotated, the temperature of each of the writing units for KC and MY increases. Subsequently, when the monochrome printing is performed, the polygon motor of the writing unit KC 1000 is rotated but the polygon motor of the writing unit MY 1001 is stopped, so that the temperature of the writing unit KC 1000 further increases but the temperature of the writing unit MY 1001 decreases.

Then, when the color printing is performed, the temperature of the writing unit for KC further increases, and the temperature of the writing unit for MY increases from the decreased temperature obtained at the monochrome printing. Then, when the monochrome printing is performed, the temperature of the writing unit for KC further increases but the temperature of the writing unit for MY decreases from the increased temperature obtained at the previous color printing.

As described above, when the color printing and the monochrome printing are repeated, a difference in the temperature between the writing unit for KC and the writing unit for MY may be increased. If the difference in the temperature between the writing units becomes large, it largely influences color misregistration. Therefore, when the difference in the temperature between the writing units is increased to a certain level, it is effective to perform a color registration process to appropriately correct color registration.

Figure 12:
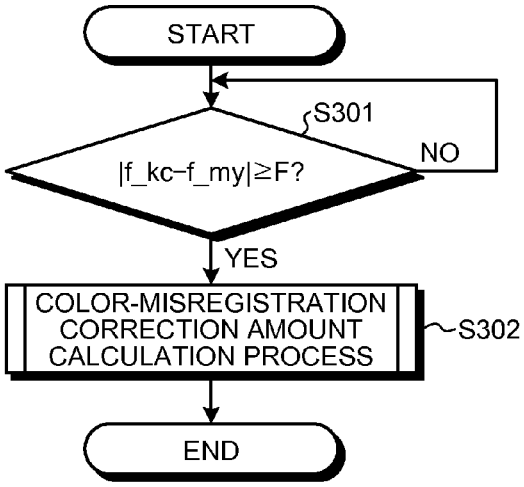
FIG. 12 is a flowchart illustrating a first example of a color registration process according to the embodiment.

Execution conditions for the color registration process are explained below. FIG. 12 is a flowchart illustrating a first example of the color registration process according to the embodiment. The control process is performed in an integrated manner by the engine control unit 113. It is assumed that the current temperature of the writing unit KC 1000 is f_kc and the current temperature of the writing unit MY 1001 is f_my. When the process is started, a difference in the temperature between the writing unit KC 1000 and the writing unit MY 1001 is calculated as represented by the following Expression (1), and it is determined by comparison whether the difference is greater than a predetermined value F (Step S301).

$$|f_kc-f_my|\geq F \tag{1}$$

At Step S301, when the difference in the temperature between the writing unit KC 1000 and the writing unit MY 1001 is smaller than the predetermined value F, a difference in the temperature is detected again. On the other hand, when the difference in the temperature between the writing unit KC 1000 and the writing unit. MY 1001 is equal to or greater than the predetermined value F at Step S301, the process for calculating the color-misregistration correction amount is performed as described above (Step S302), and the color registration process is terminated.

In the above example, only a difference in the current temperature is used as the condition for executing the color registration process, and the process is performed when the difference in the current temperature is equal to or greater than a predetermined amount. However, the condition for the color registration process may be set by using past temperature detection results.

Figure 13:
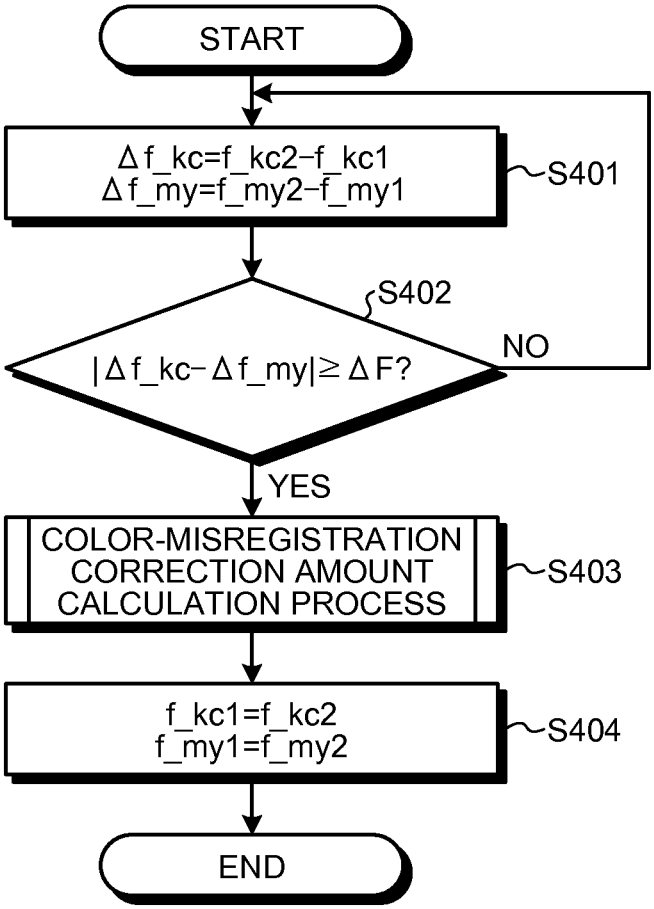
FIG. 13 is a flowchart illustrating a second example of the color registration process according to the embodiment.

Execution conditions for the color registration process using the past temperature detection results are explained below. FIG. 13 is a flowchart illustrating a second example of the color registration process according to the embodiment. The control process is performed in an integrated manner by the engine control unit 113. It is assumed that the temperature of the writing unit KC 1000 at the previous color registration process is f_kc1, the current temperature of the writing unit KC 1000 is f_kc2, the temperature of the writing unit MY 1001 at the previous color registration process is f_my1, and the current temperature of the writing unit. MY 1001 is f_my2.

When the process is started, differences between the current temperature and the temperature at the previous color registration process are obtained according to the following Expressions (11) and (12) (Step S401).

$$\Delta f_kc = f_kc2 - f_kc1 \quad (11)$$

$$\Delta f_my = f_my2 - f_my1 \quad (12)$$

A difference in the temperature between the writing unit KC 1000 and the writing unit. MY 1001 is calculated as represented by the following Expression (13), and it is determined by comparison whether the difference is greater than a predetermined value ΔF (Step S402).

$$|\Delta f_kc - \Delta f_my| \geq \Delta F \quad (13)$$

ΔF: predetermined value

At Step S402, when the difference in the temperature between the writing unit KC 1000 and the writing unit MY 1001 is smaller than the predetermined value F, the difference in the temperature is detected again. On the other hand, when the difference in the temperature between the writing unit KC 1000 and the writing unit. MY 1001 is equal to or greater than the predetermined value F, the process for calculating the color-misregistration correction amount is performed as described above (Step S403). The detected current temperature results are set as previous temperature results according to the following Expressions (14) and (1.5) (Step S404), and thereafter, the color registration process is terminated.

$$f_kc1 = f_kc2 \quad (14)$$

$$f_my1 = f_my2 \quad (15)$$

As described above, it is possible to perform the color registration process when a difference in the temperature between the writing units is equal to or greater than the predetermined value, or to perform the color registration process only when the color printing is performed.

Figure 14:
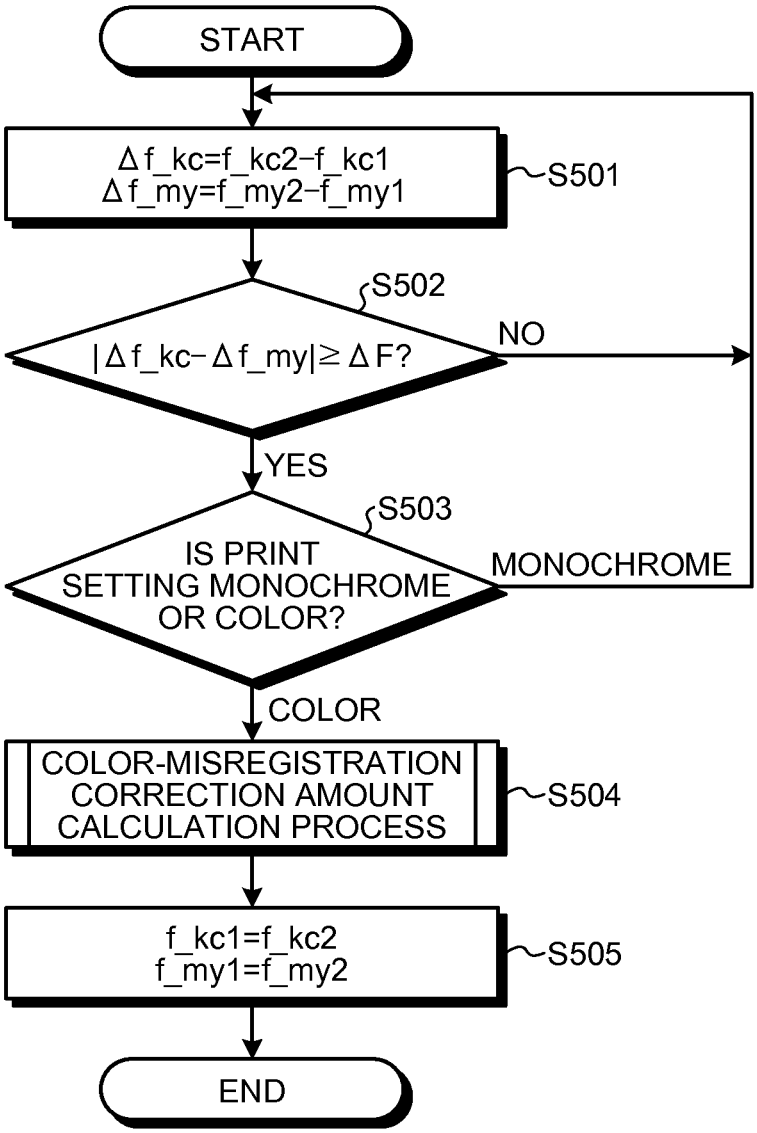
FIG. 14 is a flowchart illustrating a third example of the color registration process according to the embodiment.

Execution conditions for the color registration process, which use the past temperature results and which are applied only at the color printing, are explained. FIG. 14 is a flowchart illustrating a third example of the color registration process according to the embodiment. The control process is performed in an integrated manner by the engine control unit 113. It is assumed that the temperature of the writing unit. KC 1000 at the previous color registration process is f_kc1, the current temperature of the writing unit KC 1000 is f_kc2, the temperature of the writing unit MY 1001 at the previous color registration process is f_my1, and the current temperature of the writing unit MY 1001 is f_my2.

When the process is started, differences between the current temperature and the temperature at the previous color registration process are obtained according to the Expressions (21) and (22) (Step S501).

$$\Delta f_kc = f_kc2 - f_kc1 \quad (21)$$

$$\Delta f_my = f_my2 - f_my1 \quad (22)$$

A difference in the temperature between the writing unit KC 1000 and the writing unit MY 1001 is calculated as represented by the Expression (23), and it is determined by comparison whether the difference is greater than a predetermined value F (Step S502).

$$|\Delta f_kc - \Delta f_my| \geq \Delta F \quad (23)$$

ΔF: predetermined value

At Step S502, when the difference in the temperature between the writing unit KC 1000 and the writing unit MY 1001 is smaller than the predetermined value ΔF, the difference in the temperature is detected again. On the other hand, when the difference in the temperature between the writing unit KC 1000 and the writing unit MY 1001 is equal to or greater than the predetermined value ΔF at Step S502, it is determined whether the print setting indicates color or monochrome (Step S503). When the print setting indicates monochrome, the difference in the temperature is detected again. When the print setting indicates color, the process for calculating the color-misregistration correction amount is performed as described above (Step S504).

The detected current temperature results are set as previous temperature results (Step S505) as represented by the following Expressions (24) and (25), and thereafter, the color registration process is terminated.

$$f_kc1 = f_kc2 \quad (24)$$

$$f_my1 = f_my2 \quad (25)$$

In the embodiment, an example is explained in which a plurality of writing units is provided. However, the embodiment is not limited thereto. It is possible to provide a plurality of temperature detecting mechanisms in one writing unit or to provide a plurality of temperature detecting mechanisms in each of the writing units. Furthermore, in the embodiment, an example is explained in which a thermistor is used as the temperature detecting mechanism. However, the embodiment is not limited thereto. It is possible to predict a temperature by using a temperature detecting mechanism other than the thermistor or on the basis of number of continuously printed sheets.

Figure 15:
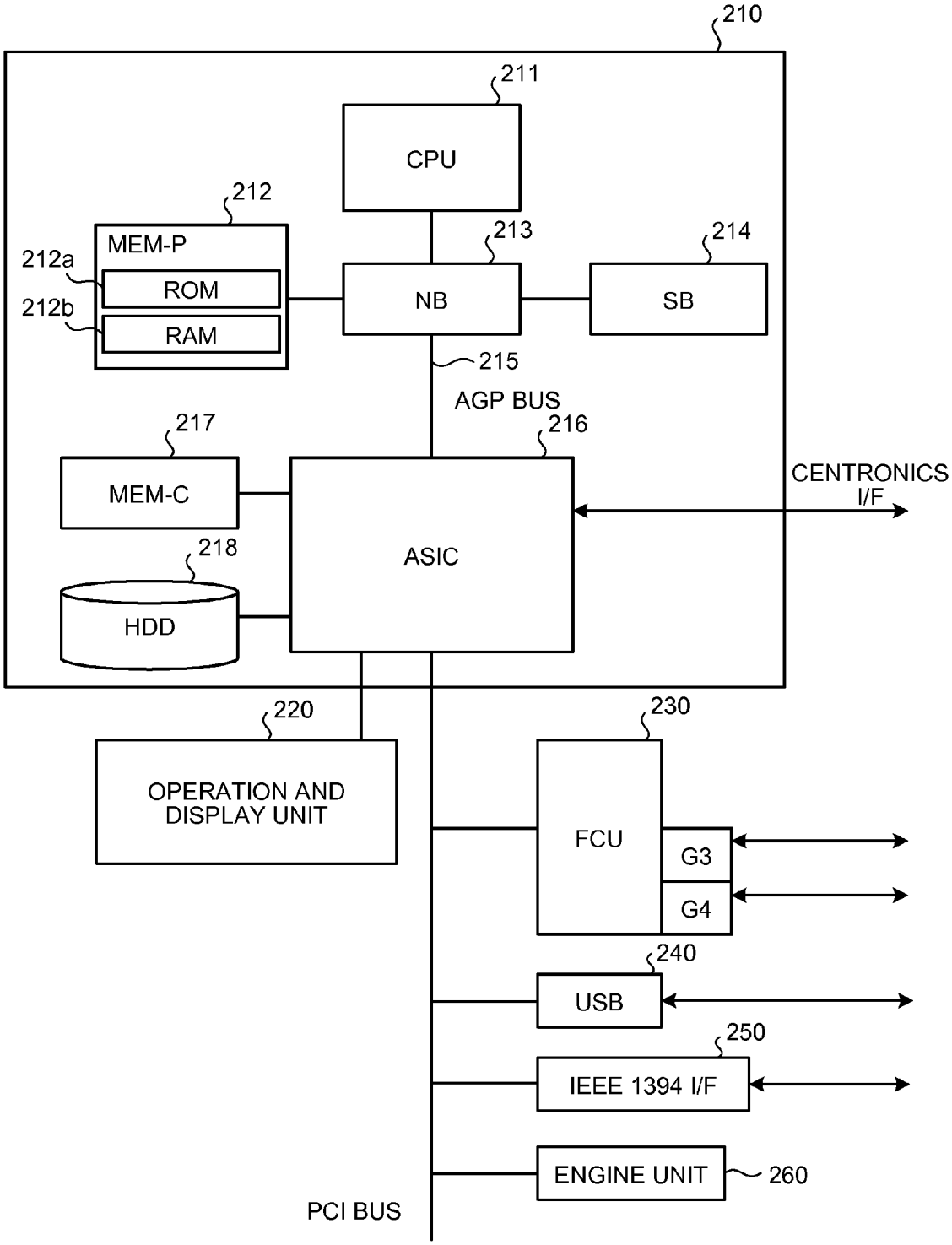
FIG. 15 is a block diagram illustrating a hardware configuration of a multifunction peripheral.

FIG. 15 is a block diagram of a hardware configuration example of a multifunction peripheral. As illustrated in FIG. 15, the multifunction peripheral includes a controller 210 and an engine unit 260 that are connected to each other via a peripheral component interface (PCI) bus. The controller 210 controls the entire multifunction peripheral, image drawing, communication, and input from an operating unit (not illustrated). The engine unit 260 is a printer engine that is connectable to the PCI bus. Examples of the engine unit 260 include a monochrome plotter, one-drum color plotter, a four-drum color plotter, a scanner, and a facsimile unit. The engine unit 260 also includes an image processing section for performing error diffusion or gamma correction, in addition to what is called an engine section such as a plotter.

The controller 210 includes a CPU 211, a north bridge (NB) 213, a system memory (hereinafter, "MEM-P") 212, a south bridge (SB) 214, a local memory (hereinafter, "MEM-C") 217, an application-specific integrated circuit (ASIC) 216, and a hard disk drive (HDD) 218. The NB 213 and the ASIC 216 are connected to each other with an accelerated graphics port (AGP) bus 215. Furthermore, the MEM-P 212 includes a read only memory (ROM) 212*a* and a random access memory (RAM) 212*b*.

The CPU 211 controls the multifunction peripheral, includes a chipset formed by the NB 213, the MEM-P 212, and the SB 214, and is connected to other devices via the chipset.

The NB 213 is a bridge for connecting the CPU 211 to the MEM-P 212, the SB 214, and the AGP bus 215, and includes a memory controller that controls reading and writing from and to the MEM-P 212, a PCT master, and an AGP target.

The MEM-P 212 is a system memory used as a memory for storing computer programs and data, a memory for loading computer programs and data therein, a memory for use in drawing a picture to be output to a printer, and the like, and includes the ROM 212*a* and the RAM 212*b*. The ROM 212*a* is a read only memory for use as a memory for storing computer programs and data. The RAM 212*b* is a writable and readable memory for use as a memory for loading computer programs and data therein, a memory for use in drawing a picture to be output to the printer, and the like.

The SB 214 is a bridge for connecting the NB 213 to PCI devices and to peripheral devices. The SB 214 is connected to the NB 213 via the PCI bus, to which a network interface (I/F) unit and the like are also connected.

The ASIC 216 that includes a hardware component for the image processing is an integrated circuit (IC) for use in image processing, and functions as a bridge that connects the AGP bus 215, the PCI bus, the HDD 218, and the MEM-C 217 therebetween. The ASIC 216 includes a PCI target and an AGP master, an arbiter (ARE) serving as the core component of the ASIC 216, a memory controller that controls the MEM-C 217, a plurality of direct memory access controllers (DMACs) that control rotation of image data and the like by hardware logic or the like, and a PCI unit that performs data transfer to and from the engine unit 260 via the PCI bus. A facsimile control unit (FCU) 230, a universal, serial bus (USE) 240, and an IEEE 1394 (the Institute of Electrical and Electronics Engineers 1394) interface (I/F) 250 are connected to the ASIC 216 via, the PCI bus. An operation and display unit 220 is directly connected to the ASIC 216. The Centronics I/F is also provided on the ASIC 216.

The MEM-C 217 is a local memory for use as a copy image buffer and a code buffer. The HDD 218 is a storage for storing image data, computer programs, font data, and forms.

The AGP bus 215 is a bus interface for a graphics accelerator card introduced to accelerating graphics operations and allows direct access to the MEM-P 212 with a high throughput, thereby accelerating operations related to the graphic accelerator card.

The computer programs to be executed by the image forming apparatus of the embodiment may be provided by being recorded in a computer-readable recording medium, such as a compact disk read-only memory (CD-ROM), a flexible disk (FD), a CD recordable (CD-R), or a digital versatile disk (DVD), in an installable or executable format. The computer programs to be executed by image forming apparatus of the embodiment may be stored in a computer connected to a network such as the Internet so that the computer programs are provided by downloading via the network. The computer programs to be executed by the image forming apparatus of the embodiment may be provided or distributed via a network, such as the Internet.

The computer programs to be executed by the image forming apparatus may be provided as being preinstalled in a ROM or the like. The computer programs to be executed by the image forming apparatus of the embodiment have a module structure made of the above-mentioned units of the image forming apparatus. As actual hardware, the CPU (processor) reads computer programs for image forming from the above recording medium and executes the computer programs to load the units on the main memory, thereby generating the above units on the main memory.

According to one aspect of the embodiment, the image forming apparatus of the embodiment can accurately adjust color registration by taking a difference in temperature into account.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus to form an image, the image forming apparatus comprising:

an optical writing device including writing units for each of a plurality of colors, the writing units being configured to write an image of image data by applying light corresponding to image data a temperature detecting unit disposed at the writing units for each of the plurality of colors in the optical writing device, the temperature detecting unit being configured to detect temperature of the writing units for each of the plurality of colors; and an adjustment processing unit that is configured to determine whether to perform a process for adjusting color registration of the image and, if the adjustment processing unit determines the process is to be performed, calculate, with respect to each of the plurality of colors a temperature difference between a past temperature detected by the temperature detecting unit for the color and a current temperature detected by the temperature detecting unit for the color, calculate a first difference between the temperature difference of a reference color of color registration correction, from among the plurality of colors, and the temperature difference of another color, from among the plurality of colors, and if the first difference is out of a reference range, form a quality verification image and perform a process for adjusting color registration of the image by using the quality verification image.

2. The image forming apparatus according to claim 1, further comprising:

a temperature storage unit that stores therein a current temperature and a past temperature of the writing units for each color.

3. The image forming apparatus according to claim 1, wherein the adjustment processing unit is configured to predicts a temperature of the writing units for each color on the basis of a number of continuously printed sheets, and configured to performs the process for adjusting the color registration in accordance with the predicted temperature.

4. The image forming apparatus according to claim 1, wherein the adjustment processing unit is configured to determine whether to perform the process for adjusting the color registration by performing the process for adjusting the color registration if a next print setting indicates color, and not performing the process for adjusting the color registration if the next print setting indicates monochrome.

5. A method of forming an image of image data implemented in an image forming apparatus that includes an optical writing device including writing units for each of a plurality of colors, the writing units writing the image by applying light corresponding to the image data, the method comprising:

detecting, by a temperature detecting unit disposed at the writing units for each color in the optical writing device, temperature of the writing units for each color;

determining whether to perform a process for adjusting the color registration of the image; and if the adjustment processing unit determines the process for adjusting color registration of the image is to be performed, performing, by the adjustment processing unit, the process for adjusting color registration of the image, by calculating, with respect to each of the plurality of colors, a temperature difference between a past temperature detected by the temperature detecting unit for the color and a current temperature detected by the temperature detecting unit for the color, calculating a first difference between the temperature difference of a reference color of color registration correction, from among the plurality of colors, and the temperature difference of another color, and if the first difference is out of a reference range, forming a quality verification image and using quality verification image.

6. The method according to claim 5, wherein determining whether to perform a process for adjusting the color registration of the image includes performing the process for adjusting the color registration if a next print setting indicates color, and not performing the process for adjusting the color registration if the next print setting indicates monochrome.

7. A computer program product comprising a non-transitory computer-readable medium having computer-readable program codes embodied in the medium for a computer to form an image of image data by an image forming apparatus that includes an optical writing device including writing units for each color that write image of image data by applying light corresponding to the image data, the program codes when executed causing the computer to execute:

detecting, by a temperature detecting unit disposed at the writing units for each color in the optical writing device, temperature of the writing units for each color;

determining whether to perform a process for adjusting the color registration of the image; and if the adjustment processing unit determines the process for adjusting color registration of the image is to be performed, performing, by the adjustment processing unit, a process for adjusting color registration of the image, by calculating, with respect to each of the plurality of colors, a temperature difference between a past temperature detected by the temperature detecting unit for the color and a current temperature detected by the temperature detecting unit for the color, calculating a first difference between the temperature difference of a reference color of color registration correction, from among the plurality of colors, and the temperature difference of another color, and if the first difference is out of a reference range, forming a quality verification image and using quality verification image.

8. The program product according to claim 7, wherein determining whether to perform a process for adjusting the color registration of the image includes performing the process for adjusting the color registration if a next print setting indicates color, and not performing the process for adjusting the color registration if the next print setting indicates monochrome.

* * * * *